US005601421A

United States Patent [19]

Lee

[11] Patent Number: 5,601,421

[45] Date of Patent: Feb. 11, 1997

[54] VALVELESS DOUBLE ACTING POSITIVE DISPLACEMENT FLUID TRANSFER DEVICE

[76] Inventor: W. Ken Lee, 3531 Princeton Corners La., Marietta, Ga. 30062

[21] Appl. No.: 607,109

[22] Filed: Feb. 26, 1996

[51] Int. Cl.[6] ..... F04B 39/10; F01L 21/02

[52] U.S. Cl. ..... 417/492; 417/500; 91/227

[58] Field of Search ..... 417/492, 493, 417/500, 532; 91/227, 233, 234

[56] References Cited

U.S. PATENT DOCUMENTS

| | | |
|---|---|---|
| 1,147,116 | 7/1915 | Nice . |
| 1,300,450 | 4/1919 | Morton . |
| 1,312,962 | 8/1919 | Dourte . |
| 1,340,310 | 5/1920 | Wolff . |
| 1,927,466 | 9/1933 | Menton . |
| 1,967,821 | 7/1934 | Hess . |
| 3,168,872 | 2/1965 | Pinkerton . |
| 3,266,432 | 8/1966 | Wortley . |
| 3,447,468 | 6/1969 | Kinne . |
| 3,597,819 | 8/1971 | Scheifele . |
| 4,008,003 | 2/1977 | Pinkerton . |
| 4,067,668 | 1/1978 | Nimell . |
| 4,941,809 | 7/1990 | Pinkerton . |
| 5,074,767 | 12/1991 | Gerlach et al. . |
| 5,246,354 | 9/1993 | Pardinas . |
| 5,287,623 | 2/1994 | Francis et al. . |
| 5,482,448 | 1/1996 | Atwater ..... 417/492 |
| 5,492,457 | 2/1996 | Lee ..... 417/405 |

FOREIGN PATENT DOCUMENTS

| | | | |
|---|---|---|---|
| 4207318 | 9/1993 | Germany | 417/500 |
| 1548506 | 3/1990 | U.S.S.R. | 417/500 |

*Primary Examiner*—Timothy Thorpe
*Assistant Examiner*—William Wicker
*Attorney, Agent, or Firm*—Richard C. Litman

[57] ABSTRACT

A valveless, double acting, positive displacement fluid transfer device is operable either as a pump when driven by a power source, or as a motor when the fluid working portion is driven by fluid under pressure through the inlet and outlet ports of the device. The device is based upon the principle of a plunger and cylinder which are angularly offset from a rotary shaft, and connected to the rotary shaft by radial arm and a spherical bearing. The plunger simultaneously rotates and reciprocates as the rotary shaft revolves, due to the plunger stroke varying cyclically due to the angular offset, as the plunger rotates within the cylinder. The plunger includes separate internal inlet and outlet passages therethrough, which cyclically communicate with an inlet port and an opposite coaxial outlet port in the cylinder to provide both suction and discharge with each plunger stroke. Various improvements in durability and manufacturing economy are provided, such as a split spherical bearing shell and a negative draft seal retainer for ease of manufacture and assembly, and a lubrication pocket for the spherical bearing for durability.

20 Claims, 3 Drawing Sheets

VALVELESS DOUBLE ACTING POSITIVE DISPLACEMENT FLUID TRANSFER DEVICE

BACKGROUND OF THE INVENTION

1. Field of the Invention

The present invention relates generally to pumps, motors, and the like using hydraulic or other fluid as a medium, and more specifically to various improvements in such a device having an angularly offset axis providing for simultaneous rotation and reciprocation of a positive displacement plunger. The improvements comprise various means providing for economy of manufacture, such as a split race for the spherical bearing incorporated therein and a negative draft casting for the seals thereof, as well as means providing for greater durability, such as a lubrication reservoir for the spherical bearing incorporated.

2. Description of the Prior Art

Positive displacement hydraulic pumps and motors using the principle of an angularly offset rotary axis to cause a piston or plunger to rotate and reciprocate simultaneously, have been known for some time. While development of such devices has continued, they nevertheless have various limitations relating to durability, reliability, cost, and ease of manufacture, particularly in such devices primarily adapted for smaller jobs and portability.

Generally in the past, the response to any such limitations has been to attack the problem from one end or the other, i. e., either the durability aspect or the cost aspect. Increases in durability have been achieved by using materials and components which are more difficult to machine and manufacture (e.g., stainless steels as opposed to softer metals and plastics), thus driving up costs, or to provide relatively inexpensive materials and manufacturing methods, thus reducing costs, but resulting in a decrease in durability and reliability. However, these two aspects are not necessarily completely mutually exclusive, as shown by the present fluid transfer device. A discussion of the limitations of the prior art, particularly in comparison with the present invention, is presented immediately below.

U.S. Pat. No. 1,147,116 issued to Budd G. Nice on Jul. 20, 1915 describes a Ball Bearing incorporating a diametrically split race. The race is not adaptable for use with a single spherical bearing, as it is not symmetrical, and even if machined for a spherical bearing, the wider portion could not be installed over the major diameter of the spherical bearing. The present invention provides for this with two symmetrical diametric spherical bearing race halves, which sandwich the single spherical bearing therein. A ball bearing configuration could not be applied to the device, as ball bearings require accurate axial alignment between rotating and fixed components at all times, whereas the angularly offset axis of the present device requires a spherical bearing to allow for the variation in alignment during each revolution.

U.S. Pat. No. 1,300,450 issued to Fred S. Morton on Apr. 15, 1919 describes a Ball Bearing having a diametrically and symmetrically split outer race, with a sleeve surrounding the two race halves to secure them together. However, Morton provides only a conical surface for his bearing race halves, as no use with other than plural ball bearings is anticipated. A plurality of smaller spherical ball bearings contained within an outer bearing race having conical surfaces, would provide only two contact points in the outer race for each ball. The present split bearing race or housing comprises a spherical concavity, closely fitting the corresponding single spherical bearing therein, and thus reducing the contact pressure at any given point. Further, the Morton bearing cannot tolerate misalignment, as provided by the present spherical bearing.

U.S. Pat. No. 1,312,962 issued to George J. Dourte on Aug. 12, 1919 describes a Valveless Pump providing double action, but the mechanism involves a crankshaft and bevel gear arrangement, in which an upper connecting rod is reciprocated by the crankshaft and rotated by the bevel gears. As the angle between the plunger rod and the connecting rod is continually changing, an additional pivotable connection must be provided between the two, as opposed to the fixed angular offset of the present fluid transfer device which allows the offset arm to be rigidly affixed to the plunger rod, thus providing a more durable mechanism. Moreover, Dourte does not provide additional volume in each end of his plunger, as provided by the present invention, for greater capacity.

U.S. Pat. No. 1,340,310 issued to George Wolff on May 18, 1920 describes an Antifriction Bearing comprising an axially split ball bearing race and cage, adapted for installation about a monolithic cylindrical crankshaft journal or the like. The spherical bearing housing of the present invention may be either axially split or diametrically split, but in either case, is adapted to fit closely about a single spherical bearing end to allow for the substantial axial misalignment between the shaft of the spherical bearing and the housing, as the alignment changes with each revolution of the angularly offset axis of the device. The axially split ball bearing race and cage of the Wolf patent cannot provide for any significant misalignment between the relatively stationary bearing block and rotating journal.

U.S. Pat. No. 1,927,466 issued to David B. Menton on Sep. 19, 1933 describes a Ball Bearing having a diametrically split outer race and a single piece inner race. While such construction provides complete enclosure for the plurality of bearing balls enclosed in the toroidal race therein, the single piece inner race cannot be separated for installation about a journal, as provided by other devices discussed above. In any case, the Menton bearing assembly is more closely related to those other devices with their plural bearing balls or spheres than to the present single spherical bearing, and cannot be adapted for use with the single spherical bearing of the present invention, or to allow for the cyclic axial alignment variation which occurs as a result of operation of the present device.

U.S. Pat. No. 1,967,821 issued to Donald P. Hess on Jul. 24, 1934 describes a Process Of Making Raceway Members for cylindrical or conically tapered roller bearings. The raceway members are formed by making rings of flat stock, and welding the ends of each ring together to make a closed raceway. The resulting closed cylindrical form is then processed and machined conventionally to form a conventional, closed bearing race. While various alternative configurations are disclosed for the blanks, they are all welded closed in the manufacturing process. Hess does not disclose any finished bearing races which are split in any way, as provided by one of the features of the present invention.

U.S. Pat. No. 3,168,872 issued to Harry E. Pinkerton on Feb. 9, 1965 describes a Positive Displacement Piston Pump in which at least one embodiment, functions similarly to the present fluid transfer device. However, numerous differences are noted. The piston or plunger of the Pinkerton pump is externally slotted, rather than having internal passages as in the present invention. While double action is provided, such is only possible using a double cylinder with the plunger having two working ends. Also, the spherical connector between the pump drive motor and the angularly offset plunger rod is installed through the wall of a cup-like component; no sealing of any lubricant around the spherical bearing is provided, nor is any means for lubricating the fitting disclosed. Further, any fluid leakage past the end of the cylinder is free to flow to the external environment, and no sealing means between plunger or rod and cylinder bore is disclosed.

U.S. Pat. No. 3,266,432 issued to Stewart W. Wortley on Aug. 16, 1966 describes a Pump having a single cylinder with a piston centrally located therein. A valve is positioned on each side of the piston, with each valve alternatingly covering and uncovering an intake and a discharge port. Reciprocation of the piston is accomplished by an angularly adjustable swash plate, rather than an angularly offset arm, as in the present invention. The device is equivalent to a two cylinder pump, with the single piston alternatingly reciprocating through the central bore of the single cylinder in each direction. While the Wortley pump is double acting, it requires the equivalent action of two cylinders in order to function in such a manner, and the complexity of separate valves which rotate and reciprocate with the piston and rod.

U.S. Pat. No. 3,447,468 issued to Walter E. Kinne on Jun. 3, 1969 describes a Metering Pump which functions somewhat along the lines of the device of the patent to Wortley discussed immediately above. Kinne, however, provides an elongated and slotted piston or plunger which also acts as a valve means as well as separating the two ends of the cylinder. A pressurized fluid is applied to one end of the cylinder through radially disposed ports, which provides reciprocation of the piston as it rotates, thereby causing a pumping action of fluid through the opposite end of the cylinder. Rather than using fluid means to reciprocate the plunger, the present invention utilizes mechanical means with an angularly offset arm.

U.S. Pat. No. 3,597,819 issued to Hudson B. Scheifele on Aug. 10, 1971 describes a Method Of Making A Composite Tapered Roller Bearing Race. The method is similar to that disclosed in the patent to Hess, discussed further above, in that two pieces of straight bar stock are rolled to form two semicircles and the ends welded together and smoothly finished to form a cylindrical bearing race. Scheifele provides only completely circular races, and does not disclose the use of split races (either diametrically or axially) in a completed bearing. In any case, the stock used by Scheifele would require further machining, in order to be compatible with a single spherical bearing as used in the present invention.

U.S. Pat. No. 4,008,003 issued to Harry E. Pinkerton on Feb. 15, 1977 describes a Valveless Positive Displacement Pump similar to that disclosed in his earlier '872 patent. However, Pinkerton recognizes the desirability of providing equal volumes at each end of the cylinder for any given respective positioning of the piston or plunger therein, and provides an idler rod which extends through the opposite end of the cylinder from the drive rod in order to displace a volume equal to that of the drive rod. This results in further complexity, in that additional sealing around the idler rod is required. While the volumes at each end of the double acting plunger of the present invention may not be precisely equal due to the single rod extending from one end of the plunger, the sealing of the present apparatus is considerably more reliable than the multiple seals required of the Pinkerton device.

U.S. Pat. No. 4,067,668 issued to Erik A. Nimell on Jan. 10, 1978 describes a Valveless Rotary-Oscillating Double-Acting Piston Pump. The pump comprises a cylinder with opposite closed ends having oblique internal surfaces, and a plunger installed therein with complementary oblique end surfaces and opposite passages communicating with opposed side ports in the cylinder. As the plunger is rotated, the ends ride against the oblique internal ends of the cylinder to force the plunger to reciprocate simultaneously, thereby alternatingly changing the volume at each end and producing a double acting pumping action. While the device is exceedingly simple, it nevertheless relies upon an internal axially sliding coupling between the motor shaft and the plunger, as well as the sliding of the plunger within the cylinder bore. The relatively small diameter rod seal and spherical bearing of the present device appear to provide lower friction and better sealing.

U.S. Pat. No. 4,941,809 issued to Harry E. Pinkerton on Jul. 17, 1990 describes a Valveless Positive Displacement Metering Pump. the device is similar to those disclosed in the same patentee's earlier '872 and '003 patents, but includes an angularly adjustable table to adjust the angular offset between the drive motor and the pump cylinder and plunger. Reversibility is provided by swinging the cylinder and plunger axis from one offset side to the other, thereby reversing the intake and outlet ports of the cylinder when the plunger is respectively in compression and expansion strokes. In any case, the same distinctions between this device and the present invention apply, as discussed further above.

U.S. Pat. No. 5,074,767 issued to C. Richard Gerlach et al. on Dec. 24, 1991 describes a Positive Displacement Pump With Rotating Reciprocating Piston And Improved Lubrication Feature. The single plunger has a single, central bore which communicates with a single lateral passage in the plunger. An inlet and an opposite outlet port are disclosed, but due to the single passage and central bore, the Gerlach et al. device is only single acting, and has no double action. Thus, when fluid is being expelled from the outlet port, no fluid is flowing into the inlet port, and vice versa. The present device provides for simultaneous inlet and outlet flow, due to the separate inlet and outlet passages and sides of the single plunger. Also, while Gerlach et al. disclose a lubrication pocket for the bearing, no means is provided to add grease to the pocket, without disassembly of the pump.

U.S. Pat. No. 5,246,354 issued to Guillermo P. Pardinas on Sep. 21, 1993 describes a Valveless Metering Pump With Reciprocating, Rotating Piston. The cylinder includes a single inlet port and two outlet ports, with the three ports being radially spaced apart about the cylinder. The single plunger includes a single relief on one side, which alternatingly communicates with the ports. The advantage of the Pardinas device is that the timing between the relief and the ports may be adjusted to provide accurate metering of fluid from the pump. However, the single relief of the plunger provides only a single acting pump, with the inlet function being idle when fluid is passing through the outlet port(s), and vice versa.

Finally, U.S. Pat. No. 5,287,623 issued to Thomas M. Francis et al. on Feb. 22, 1994 describes a Bearing Split Outer Ring And Method Of Assembly. The disclosure is directed to an axially split housing or race for use with plural individual bearing units (balls, rollers, etc.) and cannot be adapted to a single spherical bearing, as the outer race or housing is specifically divided axially into two unequal parts. The larger of the two components subtends an arc of greater than 180 degrees, and thus cannot be fit around a single spherical bearing. The problem is similar to that of the '116 patent to Nice discussed initially, in that asymmetrical bearing shells are disclosed in both patents. Nice, however, uses a diametrically split shell, whereas Francis et al. uses an axially split shell. Neither is adaptable for use with a single spherical bearing, as noted above.

None of the above inventions and patents, taken either singly or in combination, is seen to describe the instant invention as claimed.

SUMMARY OF THE INVENTION

Accordingly, it is a principal object of the invention to provide an improved valveless, double acting, positive displacement fluid transfer device which may be driven by power means to serve as a pump, or which may alternatively be driven by hydraulic or other liquid or fluid to serve as a fluid driven motor.

It is another object of the invention to provide an improved fluid transfer device which utilizes a single plunger, working in a single cylinder, to provide an inlet pulse and an outlet pulse with every plunger expansion and compression stroke to provide for double action of the device.

It is a further object of the invention to provide an improved fluid transfer device which plunger includes two separate internal passages therethrough for inlet and discharge functions.

An additional object of the invention is to provide an improved fluid transfer device which utilizes a spherical bearing between the radial arm of the motor or pump assembly and the angularly offset radial arm of the plunger assembly, and which may utilize a split bearing housing and/or lubrication pocket for the bearing, respectively for greater economy of manufacture and durability.

Still another object of the invention is to provide an improved fluid transfer device which plunger shaft seal retaining means may be formed using a negative draft process for greater economy of manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
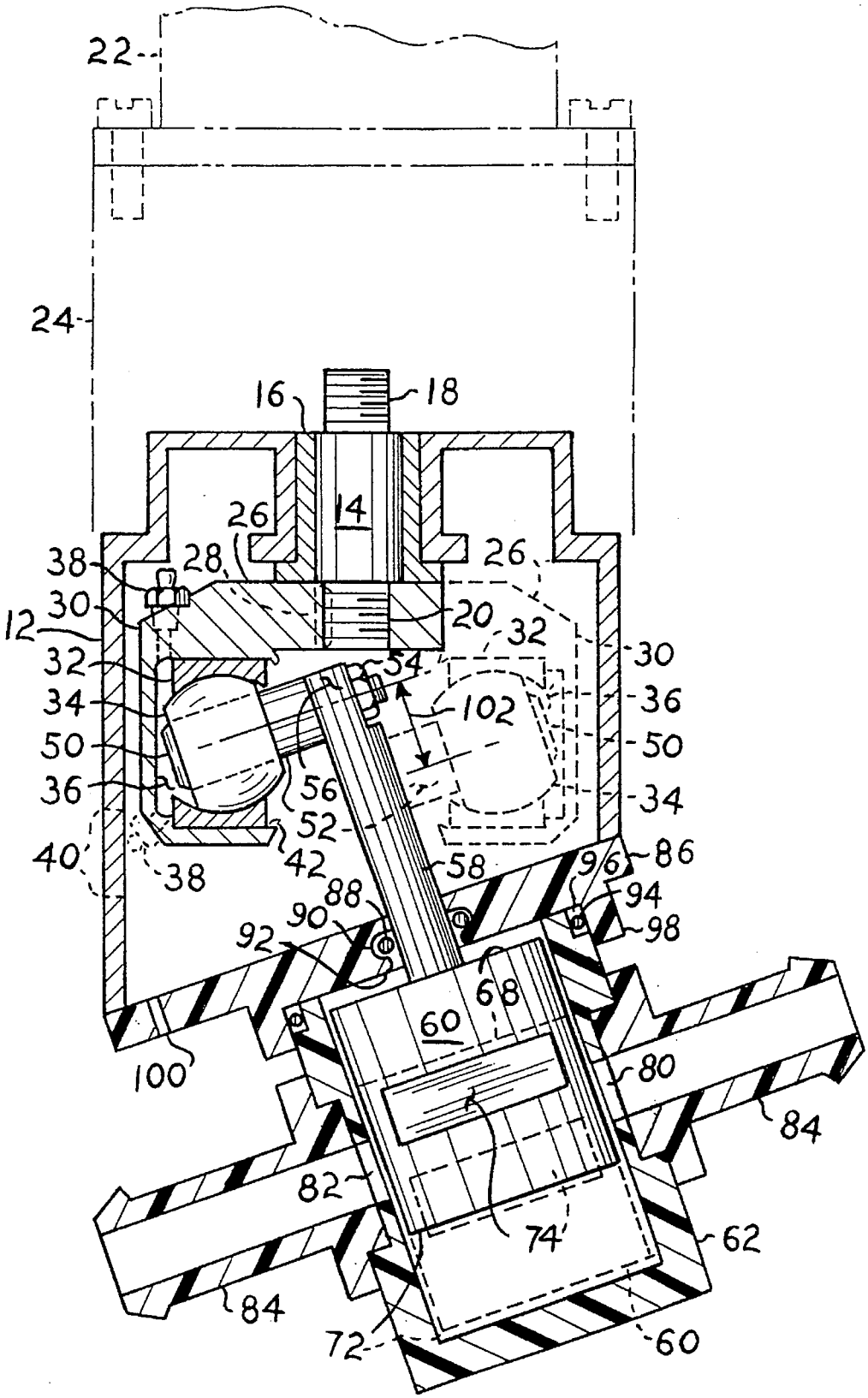
FIG. 1 is a side elevation view in section of the present valveless, double acting, positive displacement fluid transfer device, showing the internal arrangement of components and their structural details.

Referring now particularly to FIG. 1 of the drawings, the present invention will be seen to relate to a valveless, double acting, positive displacement fluid transfer device 10 which may be used as a pump to transfer fluid when driven by a prime mover (i. e., combustion engine, pneumatic or other fluid motor, electric motor, etc.), or which may alternatively be used as a motor itself when supplied with fluid under differential pressure between an inlet and an outlet port. The device 10 generally comprises a housing 12, in which a rotary shaft 14 is installed. (A bushing or sleeve 16 may be incorporated as required.)

The rotary shaft 14 has a first end 18 and an opposite second end 20. The first end 18 is used as a power input end when the device 10 is used as a pump, or alternatively may be used as the power output shaft when the device 10 is used as a motor by means of fluid being passed therethrough. As a pump, the device 10 may be connected to a prime mover 22 (i. e., engine, pneumatic or other fluid motor, alternating current or direct current electric motor, etc.) as described above, either directly or indirectly by means of a rotational speed differential 24 (speed reduction drive or speed increasing device). (The prime mover 22 is only partially shown due to its conventional nature, and the differential device 24 may be a planetary gear reduction device similar to that disclosed in applicant's application Ser. No. 08/262,980; other similarly functioning devices may be incorporated as desired.)

A radial arm 26 is securely affixed to the second end 20 of the shaft 14, so as to be incapable of movement relative to the shaft 14. A thread retaining compound such as LOCKTITE, a key 28, locking nut (not shown) or other suitable means may be used to affixedly secure the arm 26 to the shaft 14, as desired. The arm 26 has an enclosed distal end 30 having a bearing shell or race 32 securely mounted therein, which bearing shell 32 is formed with a concave spherical internal configuration to fit closely about a single spherical bearing 34. The bearing 34 and bearing race 32 therearound, in combination with the enclosed end 30 of the arm 26, define a lubrication pocket 36, which serves to contain grease or other suitable lubricant for the bearing 34 and its shell or race 32.

A grease fitting 38 or other suitable means may be provided for the addition of lubrication as required. (An alternative position for the fitting 38, indicated in broken lines, may be provided along with an access port 40, also indicated in broken lines, in the side of the housing 12, for ease of service of the bearing 34, if desired.)

Figure 5:
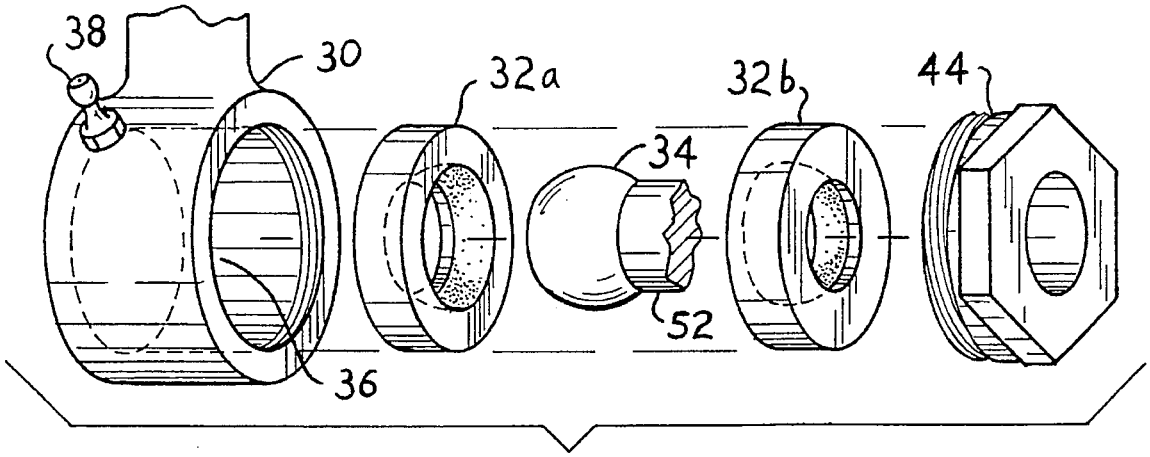
FIG. 5 is an exploded perspective view of a spherical bearing embodiment and retaining means of the present invention, using a diametrically split bearing shell and threaded retainer.
Figure 6:
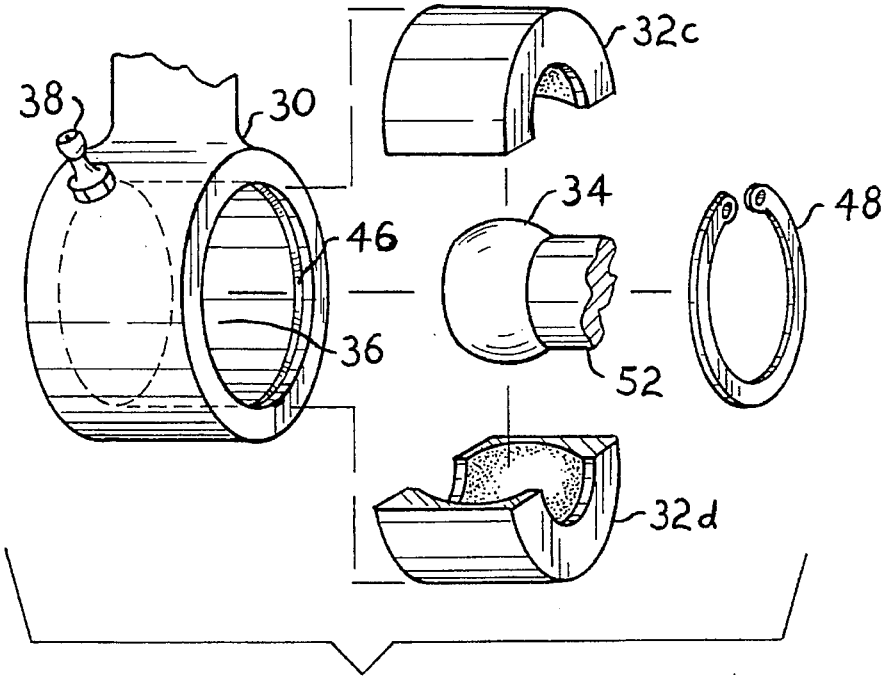
FIG. 6 is an exploded perspective view of a spherical bearing embodiment and retaining means of the present invention, using an axially split bearing shell and snap ring retainer.

The bearing race or shell 32 is retained securely within the enclosed end of the bearing enclosure 30 by means of a crimp or upset edge 42 to the inner edge of the enclosure 30, or alternatively by internally threading the enclosure 30 and securing an externally threaded locking fastener 44 thereto (FIG. 5), or by means of an internal groove 46 and snap ring 48 (FIG. 6). Other means may be used alternatively, as desired.

The spherical bearing 34 is slidingly mounted on the distal end 50 of a bearing pin 52, which is in turn relatively immovably affixed (i. e., similarly to the immovable attachment of the radial arm 26 to the shaft 14, using a lock nut 54, etc.) to the distal end 56 of a plunger rod 58. The plunger rod 58 is in turn affixed (cast in place, etc.) to a plunger 60, which simultaneously rotates and reciprocates within a cylinder 62 as the device 10 operates.

Figure 2:
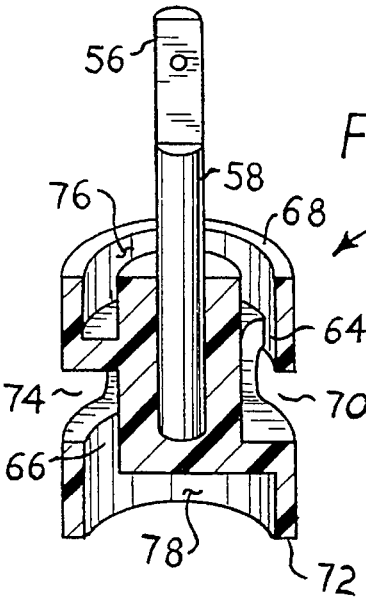
FIG. 2 is an elevation view in section of one plunger embodiment of the present fluid transfer device, showing the arrangement of the separate internal fluid passages therein.

The perspective view in section of FIG. 2 provides a better view of the specific configuration of the plunger 60. The plunger 60 includes two separate internal fluid passages, respectively designated as first and second fluid passages 64 and 66. The first passage 64 extends through the plunger 60 from the plunger rod end 68 thereof to a first lateral opening 70 in the side of the plunger 60, while the second passage 66 extends through the plunger 60 from the opposite distal end 72 of the plunger 60 to a second lateral opening 74 in the side of the plunger 60. The two lateral openings 70 and 74 are disposed diametrically opposite one another.

The plunger 60 may also include an additional volume at the plunger rod end 68 and distal end 72 thereof, respectively designated as 76 and 78. These two volumes 76 and 78 are defined by the walls at the plunger rod end 68 and opposite distal end 72 of the plunger 60, with each of the walls preferably being of substantially equal and uniform thickness due to the injection molding process preferably used to form the plunger 60 of the present fluid transfer device.

The rotating and reciprocating motion provided by the above described mechanical components, causes each of the lateral openings 70 and 74 of the plunger 60 to cyclically align with a first port 80 and second port 82 diametrically opposite thereto. These two ports 80 and 82 are preferably aligned coaxially with one another, and may have some fluid line attachment means (e. g., hose barbs 84, nipples, etc.) extending therefrom.

The cylinder 62 is affixed to a cylinder base plate 86, which also serves as an end cover for the housing 12 of the device 10. Accordingly, the base plate 86 is also affixed to the housing 12, but at an angle so as to offset the axis of the plunger rod 58, plunger 60, and cylinder 62, angularly from the axis of the rotary shaft 14 and radial arm 26. As fluid under varying pressure is present within the cylinder 62 between the plunger rod end 68 of the plunger 60 and the cylinder base plate 86, some means of dynamically sealing the rod opening through the base plate 86 is required. This may be accomplished by an O-ring 88 as shown, or alternatively by a seal having a U-shaped cross section with one side bearing against the plunger rod 58 and the opposite side bearing against the side of the plunger rod opening in the base plate 86; other sealing means may be provided as desired.

Conventionally, the seal retaining means of such a configuration was accomplished by a relatively costly machining operation, in which a relatively larger diameter internal seal groove was machined beneath a smaller diameter seal retaining lip, or a separate seal retainer was mechanically secured over the seal.

The present fluid transfer device 10 is primarily adapted for use in relatively light applications, and as such relatively pliable and low temperature materials may be used. This provides significant economy of manufacture, as for example, the cylinder base plate 86 may be cast, molded, or otherwise monolithically formed as a single unitary component with the seal retaining means already in place, without need for costly machining operations or plural seal retaining components. This process is known as "reverse draft" casting or molding, and may be done when the material being cast or molded is sufficiently pliable (as in the plastic of which the cylinder base plate is preferably formed) to be resiliently pulled from the die, even though a relatively larger portion of the die may be resiliently captured within the component during the casting or molding process.

Accordingly, a review of the cylinder base plate 86 shown in FIG. 1 will show that the O-ring 88 is retained in a seal groove 90 by a seal retaining lip 92, which is integrally formed with the cylinder base plate 86 to preclude any requirement for additional components. The seal groove 90 will be seen to have a relatively larger internal diameter than the retaining lip 92, in order to provide sufficient room for the seal 88, while still retaining the seal 88 against axial movement along the reciprocating plunger rod. The capability of the present fluid transfer device 10 to use relatively lightweight and pliable materials, such as various plastics, for such components as the base plate 86 (as well as the plunger and cylinder), provide significant economies of manufacture.

In addition to the single dynamic seal 88 around the plunger rod 58, the cylinder 62 includes a static seal 94 (O-ring, etc.) within a groove or relief 96 at the base of the cylinder 62 and cooperating with a flange 98 of the cylinder base plate 86. Thus, fluid is precluded from leakage internally into the housing 12 area containing the rotating and reciprocating mechanism, and is also precluded from external leakage between the base of the cylinder 62 and the cylinder base plate 86, by means of only two seals in the entire fluid transfer device 10: A single dynamic seal 88, and a single static seal 94. No additional seals are required due to the configuration of the present device 10, thus further simplifying manufacture and providing further economy.

In the event of some internal leakage due to a worn seal 88 or other reason, a vent or "telltale" hole 100 may be provided to vent the internal volume within the housing 12. Preferably, this telltale hole 100 is provided at a low point of the housing 12 volume (e. g., through the lowest side of the cylinder base plate 86, in the orientation of the fluid transfer device 10 as shown in FIG. 1). In this way, any fluid leakage past the dynamic seal 88 will flow downwardly and will be readily evident very soon after such leakage begins to occur. However, the telltale hole 100 may be positioned elsewhere, depending upon the orientation of the present fluid transfer device 10, or more than one hole 100 may be provided as desired.

It should be noted that the present fluid transfer device 10 is not necessarily limited to the specific configuration disclosed in FIG. 1 of the drawings, but that various alternatives may be incorporated as desired. For example, FIGS. 3A through 4B disclose alternative configurations for the plunger used in the present device 10, with the plunger of FIGS. 3A and 3B designated as plunger 60*a* and the plunger of FIGS. 4A and 4B designated as plunger 60B. The plungers 60*a* and 60*b* are similar to the plunger 60 of FIGS. 1 and 2, with the exception of the configuration of their fluid passages and openings.

Figure 3A:
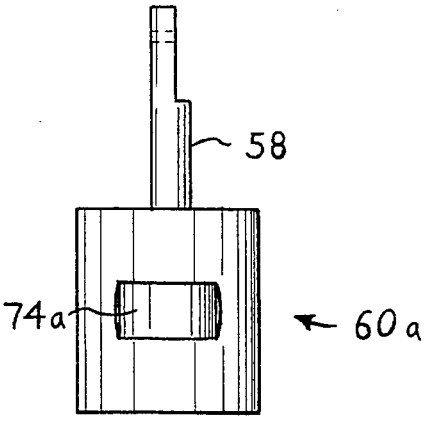
FIG. 3A is an elevation view of an alternative embodiment plunger adaptable for use with the present fluid transfer device.
Figure 3B:
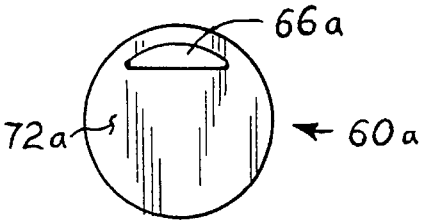
FIG. 3B is a bottom plan view of the plunger of FIG. 3A.

In FIG. 3A, the plunger 60*a* will be seen to incorporate a generally rectangular second lateral opening 74*a*, similar to the rectangular configuration of the first and second lateral openings 70 and 74 of the plunger 60 of FIGS. 1 and 2. However, the distal end 72*a* of the plunger 60*a* will be seen to include a second fluid passage 66*a* therethrough having a semicircular cross section, and is devoid of the second volume 78 formed in the distal end 72 of the plunger 60. (It will be understood that the undisclosed rod end and opposite side of the plunger 60*a*, as well as the plunger 60*b* of FIGS. 4A and 4B, may have the same configuration as the sides and ends shown respectively in FIGS. 3A and 3B, and FIGS. 4A and 4B. It should also be noted that the plunger incorporated in the present fluid transfer device is not necessarily limited to the specific fluid passages and openings shown, but that other configurations may be incorporated, and that the configurations shown may be used in combination with one another as desired.)

Figure 4A:
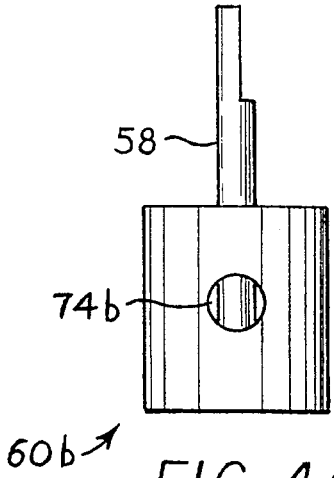
FIG. 4A is an elevation view of another alternative embodiment plunger adaptable for use with the present fluid transfer device.
Figure 4B:
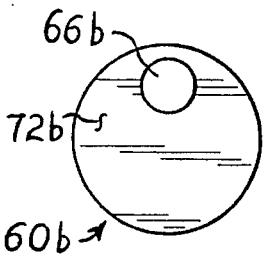
FIG. 4B is a bottom plan view of the plunger of FIG. 4A.

While the plunger 60 of FIGS. 1 and 2 includes lateral openings 70 and 74 each having a generally rectangular shape, the plunger 60*b* of FIGS. 4A and 4B includes lateral openings, e. g., the second lateral opening 74*b* as shown, and fluid passages, e. g., the second fluid passage 66*b*, each having a generally circular cross section. This may provide a sufficient cross sectional area for the internal passages, depending upon the specific configuration of the ports 80 in the sides of the cylinder 62. In the event of fittings having a circular cross section (e. g., threaded pipe nipples, etc.), a plunger 60*b* having passages, e. g. 66*b*, and lateral openings, e. g. 74*b*, may be optimally matched to such a fluid transfer device configuration. In other words, the specific plunger configuration (as well as other details) may be selected as desired for optimum efficiency and economy.

FIGS. 5 and 6 disclose alternative configurations of the race or shell for the spherical bearing 34 incorporated in the present fluid transfer device 10. Such a spherical bearing is required due to the angular variation in alignment of the bearing 34 within its shell or race, which occurs cyclically as the radial arm 26 and bearing 34 rotate. A simple pivot cannot be used, as the bearing must also accommodate rotational motion between the bearing pin 52 and the radial arm 26 through an angle equal to twice the angular offset of the plunger and cylinder assembly with the rotary shaft 14, with each complete revolution of the rotating components of the device 10. Thus, a spherical bearing 34 is required to accommodate both degrees of motion of the arrangement.

Heretofore, such spherical bearings required a race or shell which is relatively costly to manufacture and to assemble to the spherical bearing itself. The present invention responds to this problem by means of a split spherical bearing race, which is not only relatively easy to manufacture, but also provides for ease of assembly of the bearing within the race. The present bearing assembly, and particularly the race or shell, may be molded or cast of various materials due to the relatively light duty intended for the present device 10, and need not be manufactured as an inseparable component with the spherical bearing captured therein. Moreover, in the event the race or shell is machined, the machining is a much simpler operation when the two open halves of the bearing race are machined separately, rather than forming a single spherical bearing race completely surrounding the bearing.

In FIG. 5, the bearing race or shell is divided diametrically into two substantially equal portions, designated as 32*a* and 32*b*. These portions 32*a*/32*b* are assembled around the spherical bearing 34, which is in turn installed upon the end of the bearing pin 52. The assembly is then installed within the radial arm enclosed distal end 30, to define a lubrication pocket 36 therein, and secured within the enclosed distal end by suitable means, e. g., the crimp or upset 42 of FIG. 1, threaded retainer 44 of FIG. 2, snap ring of FIG. 3, etc., depending upon the specific complementary structure of the radial arm distal end 30 and the bearing 34 and bearing race 32*a*/32*b* assembly captured therein.

FIG. 6 discloses another alternative, in which the bearing race is divided axially into two substantially equal components, designated as 32*c* and 32*d*. Again, the two bearing race halves 32*c*/32*d* are assembled about the spherical bearing 34 on the end of the bearing pin 52, and the assembly installed within the closed distal end 30 of the radial arm 26. The bearing and race assembly retaining means may be an internal groove 46 formed within the enclosed radial arm end 30, with an internal snap ring 48 being placed within the groove 46, or other means, such as those discussed further above and disclosed in FIGS. 1 and 5. It will be seen that the split bearing races disclosed are not the only such configurations possible, but that the bearing race may be separated spirally or irregularly or in some other way, as desired.

The present fluid transfer device 10 is primarily adapted for use as a positive displacement pump, with power being supplied by some form of prime mover 22 as discussed above, either directly or indirectly through a speed differential 24 (gear reduction, etc.). When rotary power is applied to the rotary shaft 14, the radial arm 26 affixed thereto is also rotated, thereby causing the bearing 34 and the bearing pin 52 upon which the bearing 34 is assembled, to rotate. This also causes the plunger rod 58 to which the bearing pin is affixed, to rotate, along with the plunger 60, directly with the rotary shaft 14. This rotation will be seen to place the first and second lateral openings 70 and 74 of the plunger 60, alternatingly on opposite sides of the cylinder 62, with each revolution of the plunger 60.

Due to the angular offset of the cylinder 62, plunger 60, and plunger rod 58 relative to the rotary shaft 14, it will be seen that the plunger rod 58 will reciprocate one full stroke in each direction with each revolution of the rotating assembly, thus causing the plunger 60 to reciprocate in the same manner within the cylinder 62. The length of the reciprocation stroke is equal to the diameter of the circle defined by the travel of the bearing 34, multiplied by the sine of the offset angle between the plunger and cylinder assembly and the rotary shaft 14. This reciprocation stroke length is represented by the arrow 102 in FIG. 1.

As the plunger simultaneously rotates and reciprocates, the first and second plunger lateral openings 70 and 74 will alternately align with the first and second cylinder ports 80 and 82, which with the changing volumes within the cylinder 62 at each end of the plunger 60 due to the reciprocation of the plunger, will result in an intake of fluid at one port and a simultaneous discharge of fluid from the opposite port. Assuming that the rotation of the assembly is clockwise when viewed from the first end 18 of the rotary shaft 14, the plunger 60 will begin to travel downward within the cylinder 62 from its initial position, shown in solid lines in FIG. 1, thus reducing the volume within the lower end of the cylinder 62. The second opening 74 of the plunger 60 will also rotate to align with the second cylinder port 82, as the plunger 60 continues its downward stroke within the cylinder 62. This will be seen to discharge any fluid therein through the second port 82, by means of the plunger second fluid passage 66.

Simultaneously with the above described discharge function, the volume in the cylinder 62 at the rod end 68 of the plunger 60 is increasing, and the plunger first lateral opening 70 is rotating into alignment with the first cylinder port 80. When the opening 70 is in at least partial registry with the port 80, fluid will flow into the port 80, through the plunger lateral opening 70 and fluid passage 64, and into the increasing volume in the cylinder 62 at the plunger rod end 68. The plunger 60 completes a full stroke with each half revolution within the cylinder 62, and will thus be positioned as shown in broken lines in FIG. 1, with the first and second lateral openings 70/74 positioned generally at right angles to the cylinder ports 80/82, and rotated one hundred eighty degrees from their initial position at the upper end of the stroke.

At this point, the plunger 60 begins its upward stroke within the cylinder 62, as the bearing pin 52 continues to rotate from its position shown in broken lines in FIG. 1, toward the position shown in solid lines. The plunger first lateral opening 70, which communicates with the rod end 68 of the plunger 60 by means of the first passage 64, will revolve to align with the second cylinder port 82, with the volume in the upper end of the cylinder 62 decreasing as the plunger 60 rises. Thus, the fluid drawn into the cylinder upper end during the first half revolution, is discharged from the second port 82 due to the alignment of the plunger first lateral opening 70 therewith. Simultaneously, fluid is drawn into the increasing volume in the lower end of the cylinder 62 by the alignment of the second opening 74 with the first port 80.

The above described operation of the present fluid transfer device 10 when used as a pump, will be seen to provide simultaneous intake and discharge strokes with each upward and downward stroke of the plunger 60 within the cylinder 62, or two complete intake or suction strokes and two complete discharge strokes with each full revolution of the plunger 60 within the cylinder 62. This will be seen to provide an extremely efficient operation, particularly considering the simplicity of the present device 10 with its single cylinder 62 and plunger 60, and valveless construction.

Figure 7:
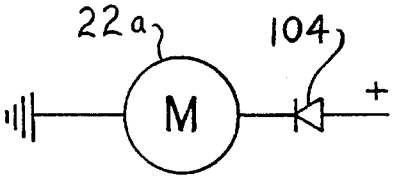
FIG. 7 is an electrical schematic of one means which may be incorporated to prevent reverse operation of the present device when used as a pump and driven by a dc electric motor.

It will also be seen that the flow through the device 10 is reversible, either by (1) turning the plunger one hundred eighty degrees on its attachment to the bearing pin 52, or (2) simply reversing the direction of rotation of the rotating assembly. The present fluid transfer device 10 is well adapted to portability and operation using a relatively small direct current electric motor, such as the motor 22*a* represented schematically in FIG. 7. Such motors 22*a* are easily reversed by merely reversing the orientation of the electrical storage battery or batteries used to power the motor 22*a*, if desired. However, oftentimes such fluid flow reversal is not desired, and in fact it may be crucial in some applications of the present device 10 to ensure that the flow remains unidirectional. Accordingly, a diode 104 may be installed in series with the dc motor 22*a*, as shown in FIG. 7, in order to preclude operation if electrical polarity is reversed. In such a circuit, if the motor and pump do not operate, the user need only reverse the battery orientation and polarity for proper operation.

The present fluid transfer device 10 is well adapted for use as a small, lightweight pump unit, but it will be seen that the device 10 may also be used as a fluid operated motor, by providing fluid under differential pressure at the two cylinder ports 80 and 82. However, with the cylinder ports 80/82 disposed diametrically opposite one another, and the two plunger lateral openings 70/74 being diametrically opposite one another and disposed precisely one quarter of a revolution from cylinder ports 80/82, a singularity may occur at precisely top dead center or bottom dead center travel of the plunger, at the positions shown in FIG. 1 respectively in broken and solid lines. Also, due to the symmetrical nature of the port 80/82 positioning relative to the plunger lateral openings 70/74, rotation in either direction is equally possible.

Accordingly, some adjustment may be needed to the port timing in order to avoid such a singularity at the extremes of the stroke travel of the plunger 60 and rod 58, and/or to ensure consistent unidirectional operation. While various adjustments may be made, e.g., positioning the lateral openings 70/74 asymmetrically in the plunger 60 and/or positioning them so they are not precisely midway between the two cylinder ports 80/82 at top and bottom dead center of the stroke travel, perhaps the easiest adjustment would be to rotate the cylinder 62, and thus the two ports 80 and 82, slightly clockwise or counterclockwise according to the desired rotation. Thus, registry of the lateral openings 70/74 with the ports 80/82 would occur only at some point other than top or bottom center of the stroke, thus ensuring rotation in the desired direction.

In summary, the present fluid transfer device 10 provides numerous improvements in such devices, relating to efficiency, economy, and reliability. The few moving parts of the valveless, single plunger and cylinder configuration, as well as the single dynamic and single static seal, provide great reliability for the device 10. The single spherical bearing, particularly when incorporated with a diametrically or axially split spherical bearing race or shell, provides additional economy of manufacture. By providing an enclosure around the outer end of the bearing, a lubrication reservoir is formed to retain grease or other lubricant adjacent the bearing and bearing race, thus providing further durability for the present fluid transfer device. As the device is particularly adapted for relatively light duty, the relatively low forces and heat developed in such applications permit various components, such as the plunger, cylinder, and cylinder base, to be cast, molded, or otherwise formed of any of a number of plastic materials, thereby providing further economy of manufacture. Other components may also be formed of such plastic materials, as desired. The formation of the cylinder base of plastic, with its integrally formed reverse draft dynamic seal channel, provides further economy by eliminating the need for the machining of an additional seal retainer. Such an economical yet durable device possesses widespread utility in many different applications.

It is to be understood that the present invention is not limited to the sole embodiments described above, but encompasses any and all embodiments within the scope of the following claims.

I claim:

1. A valveless, double acting, positive displacement fluid transfer device, comprising:

a rotary shaft having a first end and an opposite second end, with said second end having a radial arm affixed thereto and extending therefrom;

said radial arm having a distal end including a spherical bearing shell having a spherical bearing therein;

a single plunger adapted to rotate and reciprocate simultaneously within a corresponding single cylinder, with said plunger having a plunger rod end with a concentric plunger rod extending therefrom, an opposite distal end, and a lateral surface closely and sealingly fitting within said cylinder;

said plunger further having an internal first fluid passage extending from said plunger rod end through a first opening in said lateral surface, and a separate second fluid passage extending from said distal end through a second opening in said lateral surface, with said first opening and said second opening being diametrically opposite one another;

said cylinder having a lateral cylinder wall including a first port and a second port therethrough, with said first port and said second port being in coaxial alignment;

said plunger, said plunger rod, and said cylinder being angularly offset from said rotary shaft, and;

said plunger rod including a distal end having a bearing pin affixed thereto and extending radially therefrom, with said bearing pin having a distal end to which said spherical bearing is secured, whereby;

said plunger rotates with said rotary shaft as said rotary shaft revolves, and simultaneously reciprocates by means of said angular offset between said plunger and said rotary shaft, with said first opening and said second opening of said plunger alternatingly communicating with said first port and said second port of said cylinder with each reciprocating stroke of said plunger within said cylinder, to provide a double action of said fluid transfer device and positive displacement by means of said sealingly fitted plunger within said cylinder and said separate first and second internal fluid passages within said plunger.

2. The fluid transfer device according to claim 1, wherein:

said fluid transfer device comprises a motor, with motor operation provided by means of differential fluid pressure between said first port and said second port of said cylinder.

3. The fluid transfer device according to claim 1, including:

a rotational speed differential device connected to said first end of said rotary shaft.

4. The fluid transfer device according to claim 1, including:

a single dynamic seal disposed about said plunger rod and captured within a cylinder base plate through which said plunger rod passes, and a single static seal disposed between said cylinder and said cylinder base plate.

5. The fluid transfer device according to claim 1, wherein:

at least said cylinder and said plunger are formed of plastic material.

6. The fluid transfer device according to claim 1, wherein:

said fluid transfer device comprises a pump, with said rotary shaft being driven by a motor connected to said first end thereof.

7. The fluid transfer device according to claim 6, wherein:

said motor comprises a direct current electric motor, and reverse rotation of said pump is precluded by means of a diode installed in series with said motor.

8. A valveless, double acting, positive displacement fluid transfer device, comprising:

a rotary shaft having a first end and an opposite second end, with said second end having a radial arm affixed thereto and extending therefrom;

said radial arm having a distal end including a spherical bearing shell having a spherical bearing therein;

said bearing shell comprising a first and a separate second portion, with each said bearing shell portion being substantially equal and symmetrical to one another;

a single plunger adapted to rotate and reciprocate simultaneously within a corresponding single cylinder, with said plunger having a plunger rod end with a concentric plunger rod extending therefrom, an opposite distal end, and a lateral surface closely and sealingly fitting within said cylinder;

said plunger further having at least two fluid passages incorporated integrally therewith;

said cylinder having a lateral cylinder wall including a first port and a separate second port therethrough;

said plunger, said plunger rod, and said cylinder being angularly offset from said rotary shaft, and;

said plunger rod including a distal end having a bearing pin affixed thereto and extending radially therefrom, with said bearing pin having a distal end to which said spherical bearing is secured within said first and said second bearing shell portion, whereby;

said plunger rotates with said rotary shaft as said rotary shaft revolves, and simultaneously reciprocates by means of said angular offset between said plunger and said rotary shaft, with said at least two fluid passages of said plunger alternatingly directly communicating with said first port and said second port of said cylinder with each reciprocating stroke of said plunger within said cylinder, to provide a double action of said fluid transfer device and positive displacement by means of said sealingly fitted plunger within said cylinder and said at least two fluid passages within said plunger, with each said bearing shell component providing for ease of manufacture, assembly, and disassembly of said device as required.

9. The fluid transfer device according to claim 8, wherein:

said spherical bearing shell is diametrically split to form said first and said second portion thereof.

10. The fluid transfer device according to claim 8, wherein:

said spherical bearing shell is axially split to form said first and said second portion thereof.

11. The fluid transfer device according to claim 8, wherein:

said fluid transfer device comprises a pump, with said rotary shaft being driven by a motor connected to said first end thereof.

12. The fluid transfer device according to claim 8, wherein:

said fluid transfer device comprises a motor, with motor operation provided by means of differential fluid pressure between said first port and said second port of said cylinder.

13. The fluid transfer device according to claim 8, including:

a single dynamic seal disposed about said plunger rod and captured within a cylinder base plate through which said plunger rod passes, and a single static seal disposed between said cylinder and said cylinder base plate.

14. The fluid transfer device according to claim 8, wherein:

at least said cylinder and said plunger are formed of plastic material.

15. The fluid transfer device according to claim 8, including:

a bearing enclosure disposed about said spherical bearing and said bearing shell, with said enclosure providing a lubrication pocket for said bearing and said bearing shell.

16. The fluid transfer device according to claim 15, including:

a lubrication supply fitting disposed through said bearing enclosure and communicating with said lubrication pocket, with said fitting providing for the replenishment of lubrication means within said pocket as required.

17. A valveless, double acting, positive displacement fluid transfer device, comprising:

a rotary shaft having a first end and an opposite second end, with said second end having a radial arm affixed thereto and extending therefrom;

said radial arm having a distal end including a spherical bearing shell having a spherical bearing therein;

a single plunger adapted to rotate and reciprocate simultaneously within a corresponding single cylinder, with said plunger having a plunger rod end with a concentric plunger rod extending therefrom, an opposite distal end, and a lateral surface closely and sealingly fitting within said cylinder;

a cylinder base plate to which said cylinder is affixed, with said cylinder base plate including a plunger rod passage therethrough;

said plunger rod passage of said cylinder base plate including a dynamic seal captured therein by means of a negative draft seal retainer formed integrally with said cylinder base plate, wherein said seal retainer includes a seal groove and a seal retaining lip, with said seal groove having a larger diameter than said seal retaining lip;

said plunger further having at least two fluid passages incorporated integrally therewith;

said cylinder having a lateral cylinder wall including a first port and a separate second port therethrough;

said plunger, said plunger rod, and said cylinder being angularly offset from said rotary shaft, and;

said plunger rod including a distal end having a bearing pin affixed thereto and extending radially therefrom, with said bearing pin having a distal end to which said spherical bearing is secured, whereby;

said plunger rotates with said rotary shaft as said rotary shaft revolves, and simultaneously reciprocates by means of said angular offset between said plunger and said rotary shaft, with said at least two fluid passages of said plunger alternatingly directly communicating with said first port and said second port of said cylinder with each reciprocating stroke of said plunger within said cylinder, to provide a double action of said fluid transfer device and positive displacement by means of said sealingly fitted plunger within said cylinder and said at least two fluid passages within said plunger, with said plunger rod being sealed within said plunger rod passage of said cylinder base plate by means of said negative draft seal retainer and said seal captured therein.

18. The fluid transfer device according to claim 17, wherein:

said fluid transfer device comprises a pump, with said rotary shaft being driven by a motor connected to said first end thereof.

19. The fluid transfer device according to claim 17, wherein:

said fluid transfer device comprises a motor, with motor operation provided by means of differential fluid pressure between said first port and said second port of said cylinder.

20. The fluid transfer device according to claim 17, wherein:

at least said cylinder, said plunger, and said cylinder base plate are formed of plastic material.

* * * * *